US010453296B2

(12) United States Patent
Anderson et al.

(10) Patent No.: US 10,453,296 B2
(45) Date of Patent: Oct. 22, 2019

(54) METHOD AND SYSTEM FOR LOTTERY GAME PLAY TRANSACTIONS VIA A KIOSK AND A PLAYER'S MOBILE SMART DEVICE

(71) Applicant: Scientific Games International, Inc., Newark, DE (US)

(72) Inventors: Peter Rys Anderson, Northbrook, IL (US); Quincy Wallace Raven, Las Vegas, NV (US)

(73) Assignee: Scientific Games International, Inc., Newark, DE (US)

( * ) Notice: Subject to any disclaimer, the term of this patent is extended or adjusted under 35 U.S.C. 154(b) by 223 days.

(21) Appl. No.: 14/859,999

(22) Filed: Sep. 21, 2015

(65) Prior Publication Data

US 2017/0084116 A1 Mar. 23, 2017

(51) Int. Cl.
*G07F 17/32* (2006.01)

(52) U.S. Cl.
CPC ..... *G07F 17/3225* (2013.01); *G07F 17/32* (2013.01); *G07F 17/329* (2013.01); *G07F 17/3218* (2013.01); *G07F 17/3244* (2013.01)

(58) Field of Classification Search
CPC .... G07F 17/32; G07F 17/329; G07F 17/3218; G07F 17/3225; G07F 17/3244
(Continued)

(56) References Cited

U.S. PATENT DOCUMENTS 9,208,652 B2 12/2015 Aligizakis et al.
2006/0025222 A1* 2/2006 Sekine ..... G07F 17/32 463/42

(Continued)

FOREIGN PATENT DOCUMENTS

EP 1 622 104 A2 2/2006
WO WO 2014/045212 A2 3/2014

OTHER PUBLICATIONS

PCT Search Report, dated Dec. 19, 2016.

*Primary Examiner* — Omkar A Deodhar
*Assistant Examiner* — Wei Lee
(74) *Attorney, Agent, or Firm* — Dority & Manning, P.A.

(57) ABSTRACT

A system and associated method are provided for conducting a lottery game play purchase at a retail establishment. At an interactive kiosk located within the retail establishment and in communication with a central lottery server, payment is accepted from a player via the kiosk for a lottery game play selected by the player at the kiosk. A transaction ID is generated at the server associated with the lottery game play, and is transmitted back to the kiosk. The player is able to input the transaction ID to their mobile smart device via an application downloaded to the mobile smart device, wherein the application generates an identifier code unique to the mobile smart device. The identifier code is transmitted by the mobile smart device to the server and is stored with the transaction ID in a file, along with the identity of the selected lottery game plays. For subsequent play of the lottery game play, the server accepts the identifier code transmitted by the mobile smart device and, if validated, retrieves and transmits the selected lottery game plays to the mobile smart device for subsequent play of the games. The server does not require or store personal information related to the player with the unique identifier and transaction ID for conducting the lottery game play transaction.

16 Claims, 4 Drawing Sheets

(58) Field of Classification Search
USPC ..... 463/17
See application file for complete search history.

(56) References Cited

U.S. PATENT DOCUMENTS

| | | | | |
|---|---|---|---|---|
| 2009/0280894 | A1* | 11/2009 | Kobayashi | A63F 13/12 463/30 |
| 2010/0203943 | A1* | 8/2010 | Hughes | G07F 17/32 463/17 |
| 2011/0086693 | A1* | 4/2011 | Guziel | G07F 17/32 463/17 |
| 2012/0089468 | A1 | 4/2012 | Guziel | |
| 2013/0017884 | A1* | 1/2013 | Price | G07F 17/32 463/25 |

* cited by examiner

METHOD AND SYSTEM FOR LOTTERY GAME PLAY TRANSACTIONS VIA A KIOSK AND A PLAYER'S MOBILE SMART DEVICE

FIELD OF THE INVENTION

The present invention relates generally to a method and system for conducting lottery transactions, and more particularly to such transactions and game plays enabled on a player's mobile smart device.

BACKGROUND

Lottery games have become a time honored method of raising revenue for state and federal governments the world over. The success of these games, however, depends on continuous innovations that capture the interests of current players and draw new players to the games.

As with other consumers, lottery players are becoming more tech savvy, and are interested in the convenience of conducting various gaming aspects via electronic devices, such as smart phones or other types of mobile smart devices. The gaming industry is appreciative of this fact, and is seeking ways to integrate games and gaming-related functions into the rapidly developing mobile electronic communication age.

With conventional systems and methods, authorized retail vendors within a lottery jurisdiction are the primary means of lottery ticket sales and distribution. This relationship has been beneficial to the vendors in that lottery players also tend to purchase additional goods in the retail establishment. The gaming authority (e.g., a state or other governmental lottery authority) benefits in that a wide and varied sales and distribution network is provided by the authorized retail establishments.

It is important that new innovations in the gaming industry, particularly with respect to electronic gaming via smart phones or other mobile smart devices, attempt to preserve this mutually beneficial relationship. This is of particular concern to the retail vendors as electronic and on-line lottery ticket sales are growing in acceptance and popularity, and could potentially decrease lottery player traffic to the retail establishments.

The lottery industry is thus continuously seeking new and creative gaming scenarios that provide increased entertainment value to players, entice new players, and expand play of lottery games into the smart electronic communication age while at the same time maintaining or increasing lottery player foot traffic to the conventional ticket sales retail establishments

SUMMARY

Objects and advantages of the invention will be set forth in part in the following description, or may be obvious from the description, or may be learned through practice of the invention.

In accordance with aspects of the invention, a method is provided for conducting a lottery game play purchase at a retail establishment wherein lottery game purchases are authorized by a lottery authority. Such locations include, for example, convenience stores, gaming establishments, pubs, retail stores (including "big-box" retail chain stores), and so forth. It should be appreciated that the type of retail establishment is not a limiting factor of the invention.

At an interactive kiosk located within the retail establishment and in communication with a central lottery server, payment is accepted from a player via the kiosk for a lottery game play. For example, the kiosk may accept cash input or be configured to process a credit card transaction. The player may select one or more games from a menu of different games for purchase at the kiosk. The term "kiosk" is used herein in a generic sense to encompass any configuration of an interactive station or terminal presented to players, wherein the gaming functions described herein are enabled for the player. The kiosk may include any configuration of hardware/processor, software, display, player interface, etc., for this purpose.

The central lottery server generates a transaction ID at the server associated with the purchase transaction and the selected lottery game play, and creates and stores an electronic file associated with the transaction ID. The server transmits the transaction ID back to the kiosk, which then provides the transaction ID to the player. Upon receipt of the transaction ID, the player is able to input the transaction ID to their mobile smart device via an application downloaded to the mobile smart device. This application may be made available to players for download by a host lottery system (or any other entity authorized by the lottery jurisdiction). Upon receipt of the transaction ID, the application generates an identifier code that is unique to the mobile smart device. In other words, no two mobile smart devices are linked to the same identifier code. The identifier code is transmitted from the mobile smart device to the server.

At the server, the unique identifier code transmitted by the mobile smart device is accepted and stored in the electronic file with the transaction ID and the identity of the selected lottery game play(s).

In certain embodiments, the transaction ID may only reference a monetary value entered by the player via the kiosk. Once the transaction ID and referenced monetary value have been associated with the player's smart mobile device, the player can proceed to select games play via the mobile device, as described below. It may be desired in certain embodiments, to limit this function by location of the mobile device. For example, the ability to use the mobile device as set forth herein may be geo-fenced to the retail store in which the kiosk is located, or within a defined proximity to the kiosk, or within a state/jurisdiction's boundary. Methods of geo-fencing to defined locations are well known to those skilled in the art, and include, for example, IP identification, Wi-Fi triangulation, blue tooth, an others.

For subsequent play of the selected lottery game play on the mobile smart device at a time of the player's choosing, the server accepts the identifier code transmitted by the mobile smart device (via the downloaded application), verifies the identifier code against the stored identifier code, and retrieves and transmits the selected lottery game plays to the mobile smart device.

It should be appreciated that, with the method and associated system described herein, the server does not require or store personal information related to the player with the unique identifier code or the transaction ID for conducting the lottery game plays. In essence, it is the mobile smart device that is verified for play of the game, not the player holding the smart device. Player anonymity is insured throughout the transaction and play of the selected lottery games, which may be highly desirable, feature for certain players.

In certain embodiments, the lottery game plays made available to the players are predetermined and revealed to the player by simulated play of the lottery game play on the mobile smart device. For example, the games may emulate conventional scratch-off lottery tickets that scratched virtually on the mobile smart device to reveal the game results. In other embodiments, the game play may be an entry in a future draw game.

In some instances, the winnings from games purchased and revealed on the mobile device may be used to rebuy new games. These new purchases may also be associated with the original transaction ID and retrieved from the host lottery system. As before, these new games may also be limited by location of the mobile device (e.g., geo-fencing).

The unique identifier code is generated by the application on the mobile smart device and may be unique for each transaction ID. The identifier code is preferably not retrievable from the phone and is limited by the application to transmission only to the lottery server, which prevents a player from transmitting the identifier code to a third party. In an alternative embodiment, the identifier code may be common to a plurality of transaction ID's such that the identifier code essentially functions as a unique signature for the particular mobile smart device for multiple lottery game plays. With this embodiment, the identifier code can be changed periodically.

For the "unique" aspect of the identifier code, the method may include generating the identifier code from the unique media access control (MAC) address associated with the particular mobile smart device. However, MAC addresses are generally not secure, and the method may further include generating an encrypted hash of the MAC address with a hash key stored on the mobile smart device. The server may transmit the hash key to the mobile smart device with the transaction ID, or the mobile smart device may generate the hash key and transmit it to server. The hash keys may be periodically changed, which requires updating of the hash keys on the mobile smart device and at the server.

In an alternate embodiment, the identifier code may be a random code generated by the application on the mobile smart device, which may then be hashed with any other information or code component.

The identifier code has a component or link to the stored file at the server associated with the initial transaction. In this regard, it may be desirable in certain embodiments to include the transaction ID as a component of the identifier code, wherein upon decryption of the identifier code, the server uses the transaction ID component of the identifier code to retrieve the associated stored file, which contains the identity of the selected lottery game plays (or the actual game plays) that are eventually transmitted to the player's mobile smart device. For example, the identifier code may be an encrypted hash of the transaction ID and a component unique to the mobile smart device, such as the MAC address associated with the mobile smart device or a random number generated by the mobile smart device.

The transaction ID may be provided to the player in the form of a code transmitted to the kiosk, wherein the code is scannable by the player with the mobile smart device from a screen at the kiosk or from a printed receipt that contains the code.

In an alternate embodiment, the code may be transmitted electronically by the kiosk to the player's phone using a conventional wireless transmitting capability, such as a conventional BTLE (blue tooth low energy) application.

Once the games associated with the transaction ID have been played on the mobile device, the player may then communicate the transaction ID to the retail establishment for payout of winnings from the games associated with the respective transaction ID. This communication can be by presenting a printed kiosk receipt to the retailer, or through a secure wireless mobile connection to retailer equipment, such as the same or another lottery-related kiosk.

Certain lottery jurisdictions may require some form of age verification of players that purchase game plays via the kiosk. This can be accomplished in any number of ways that are conventionally used to verify the age of players at gaming terminals, such as slot machines located in retail establishments. For example, the kiosk may be placed in the retail establishment at a location that permits a clerk or other employee to see and, if necessary, verify the age of the players. In an alternate embodiment, the kiosk may be in communication with a conventional and commercially available third party age verification service.

The method may further include a redemption process wherein a winning lottery game play is credited to an account linked by the server to the unique identifier, with the account is accessible to the player upon subsequent transmission and receipt of the unique identifier by the server for prize redemption at an authorized redemption location or purchase of additional lottery game plays.

A "lottery jurisdiction" is understood to be a geographic area, such as a state, territory, or the like, governed by a governmental authority. A typical example of a lottery jurisdiction is an individual state-sponsored lottery, such as the Georgia (USA) or Connecticut (USA) state lotteries. A lottery jurisdiction may also encompass multiple states or territories that participate in a national-scale lottery game, such as the PowerBall™ and Mega Millions™ games in the United States.

A "lottery authority" is understood to be the governmental body, agency, or other organization that governs play of lottery games in a particular jurisdiction. For example, the Connecticut Lottery Corporation is the lottery authority for play of lottery games in Connecticut. A lottery authority may also be an organization that governs play of multi-state games (games across multiple jurisdictions). An example of such an organization is MUSL (Multi-State Lottery Association) in the United States that administers the PowerBall™ and Mega Millions™ games for its member states.

A "host lottery provider" is understood to be the system and associated entity that implements the logistical aspects of the lottery game for the lottery authority, such as printing and supplying tickets, providing server and computer services required to manage the various games, providing redemption services, and so forth. The host lottery provider may be an entity of the lottery authority, or may be implemented by a third party provider. An example of a host lottery provider is the system and services provided by Scientific Games International, Inc., of Alpharetta, Ga., USA.

The present invention also encompasses various system embodiments incorporating the structure and operational principles set forth above and discussed in greater detail below.

BRIEF DESCRIPTION OF THE DRAWINGS

A full and enabling disclosure including the best mode of practicing the appended claims and directed to one of ordinary skill in the art is set forth more particularly in the remainder of the specification. The specification makes reference to the appended figures, in which:

DETAILED DESCRIPTION

Reference will now be made in detail to various and alternative exemplary embodiments and to the accompanying drawings, with like numerals representing substantially identical structural elements. Each example is provided by way of explanation, and not as a limitation. In fact, it will be apparent to those skilled in the art that modifications and variations can be made without departing from the scope or spirit of the disclosure and claims. For instance, features illustrated or described as part of one embodiment may be used on another embodiment to yield a still further embodiment. Thus, it is intended that the present disclosure includes modifications and variations as come within the scope of the appended claims and their equivalents.

Figure 1:
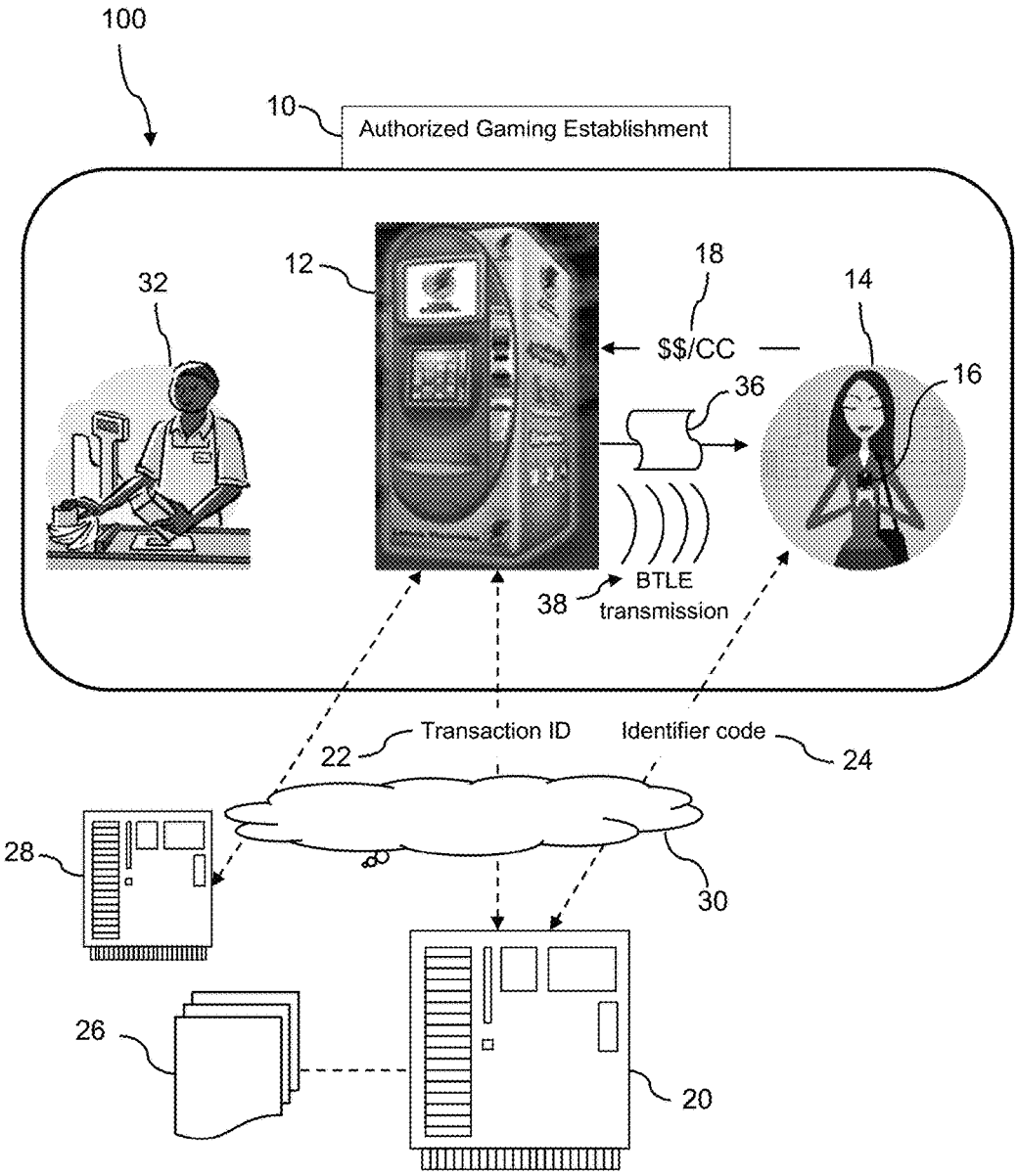
FIG. 1 is a diagram of a system and associated methodology in accordance with aspects of the present invention.

Referring to FIG. 1, a system and associated method 100 in accordance with aspects of the invention are depicted for conducting a lottery game play purchase at a retail establishment 10 wherein such lottery game purchases are authorized by a lottery authority within a given lottery jurisdiction. As mentioned above, the type of retail establishment 10 may vary widely within the scope and spirit of the invention. A retail establishment or location 10, such as a retail store, convenience store, pub, restaurant, or the like, is generally authorized by the lottery authority to carry out lottery activities within the respective jurisdiction, such as the sale of instant scratch-off tickets or terminal based tickets for draw games such as PowerBall™ issued from a lottery terminal. As discussed above, the lottery jurisdiction may be a state and the lottery authority may be a governmental agency or entity, such as the Pennsylvania Lottery. A separate host lottery game provider may be partnered with the lottery jurisdiction to provide certain control, implementation, and logistical functions of the game. In the embodiments described herein, the host game provider maintains the lottery central server 20. However, this is not a limitation of the invention. The server 20 may just as well be maintained by the lottery authority.

Although not limited to such, the present system and method 100 have particular usefulness for larger retail establishments, such as "big-box" retail stores that are part of a national or other geographic chain. It should be appreciated that the invention encompasses a single retail establishment 10, as well as a multitude of establishments 10 in communication with the lottery central server 20.

FIG. 1 depicts an interactive kiosk 12 located within the retail establishment wherein players 14 (i.e., patrons of the establishment 10) are able to purchase one or more plays of a lottery game, such as a virtual scratch-off ticket, as described in greater detail below. The kiosk 12 may have a screen, keypad, or any other conventional input/output configuration wherein the player 14 is able to purchase game plays. For example, the kiosk 12 may present a menu to the player via a screen that steps the player 12 through the purchase transaction. The menu may include identification of a plurality of possible games that can be purchased in a single or multiple transactions.

The player 14 is depicted with a mobile smart device 16, such as a smart phone, tablet, PDA, or other network-enabled device (all referred to herein generically as a "mobile smart device"). The mobile smart device 16 has an application downloaded thereon that allows the device 16 to function as described herein. This application may be provided for download by the host lottery provider, or any other entity authorized by the lottery authority.

In certain embodiments, the player's mobile smart device 16 may communicate wirelessly with the kiosk 12 via a suitable wireless system 38 for receipt of a transaction ID 22 (explained in greater detail below), or any other input/output functions. With this implementation, the downloaded application may be linked to a low power background application that allows the mobile smart device 16 to function as a receiver to receive transmissions of signals from the kiosk within a certain range. Once the mobile smart device 16 detects such a signal from the kiosk 12, certain other application functions are initiated on the mobile smart device 16. For example, the mobile smart device 16 may "react" to the received signal and start the gaming application.

It has been found that Bluetooth Low Energy (BTLE) technology is particularly well-suited for embodiments wherein the mobile smart device 16 communicates wirelessly with the kiosk 12. For example, the kiosk 12 may be configured with a BTLE beacon, while the mobile smart device is configured by the downloaded application (or a different downloaded application) to receive and recognize the BTLE formatted signal 14 within a defined range of the kiosk 12. BTLE devices are well-known to those skilled in the art, and a detailed explanation of their function and operation is not necessary for an understanding and appreciation of the present invention. Briefly, BTLE beacons are a class of low-energy, low-cost radio transmitters that can notify mobile smart devices 16 (e.g., iOS 7 smart phones) running BTLE applications of their presence, which in turn enables the smart device 16 to perform certain actions when in close proximity to the beacon. These devices are often referred to as "iBeacons", which is the name Apple chose for its implementation of the BTLE technology. Each BTLE beacon broadcasts a unique identification signal using the BTLE standard format. These signals are also known as iBeacon "advertisements." The mobile smart device 16 runs a low power background application that enables the device to scan for and receive the signals within transmitting range of the BTLE beacons. The mobile smart device 16 will automatically "react" to the received signal and may start other BTLE-enabled gaming applications for various purposes, including communication with the central server 20.

It should be appreciated that the wireless communication function is not limited to BTLE technology. Other transmitter/receiver technologies may also be utilized for practice of the invention. For example, Near Field Communication (NFC) implementations may be utilized. In another embodiment, Radio Frequency Identification (RFID) technology may be used. Other communication technologies are also within the scope and spirit of the invention.

Referring again to FIG. 1, a payment medium 18 is depicted as being input to the kiosk 12 for purchase of one or more lottery game plays. In this regard, the kiosk 12 may be configured to accept cash or transact a credit/debit card transaction with a third party financial institution.

FIG. 1 depicts an embodiment wherein the transaction ID is transmitted wirelessly to the mobile smart device 16 via, for example, the wireless communication system 38 described above.

FIG. 1 also depicts an embodiment wherein the kiosk 12 presents a printed receipt 36 to the player 14 that contains the transaction ID 22. This ID 22 may be in the form of a scannable code, such as a QR code, that the player scans into their mobile smart device 16. In another embodiment, the transaction ID 22 may be presented to the player via a code on a monitor or screen, wherein the player scans the code directly from the screen. In still another embodiment, the transaction ID may be an alpha-numeric code that is manually input by the player 14.

As mentioned above, the lottery authority may require age verification of the players 14 that purchase lottery game plays via the kiosk 12. This may be accomplished in any number of ways that are conventionally used to verify the age of players at gaming terminals, such as slot machines located in retail establishments. For example, the kiosk 12 may be placed in the retail establishment 10 at a location that permits a clerk 32 or other employee to see and, if necessary, verify the age of the players. In an alternate embodiment, the kiosk 12 may be in communication with a conventional and commercially available third party age verification service 28 that verifies the player's age based on certain information transmitted by the player, such as a driver's license number, address, and so forth. For example, Veratad Technologies, LLC, of Teaneck, N.J., USA, offers such an online age verification service known as AgeMatch$^{SM}$. To ensure player anonymity, data transmitted from the kiosk 12 to the third party age verification service 28 is not transmitted to the central server 20.

FIG. 1 also depicts that the kiosk 12 and the player's mobile smart device 16 are in wireless communication with the game server 20 via a suitable secure communication network 30, which may include any manner of wide area network, wireless internet, or cloud computing.

The game server 20 may be a single networked computer, or a series of interconnected computers having access to the communications network via a gateway or other known networking system. Generally, the game server 20 is configured to communicate with, manage, execute and control individual kiosks 12 at one or more retail establishments 10 within the lottery jurisdiction, and to interface with the network enabled mobile smart devices 16 of the players 14. The game server 20 may include a memory for storing gaming procedures and routines, a microprocessor (MP) for executing the stored programs, a random access memory (RAM) and an input/output (I/O) bus. These devices may be multiplexed together via a common bus, or may each be directly connected via dedicated communications lines, depending on the needs of the system 100. The game server 20 may be directly or indirectly connected through the I/O bus to any manner of peripheral devices such as storage devices, wireless adaptors, printers, and the like. In addition, a database (DB) may be communicatively connected to the game server 20 and provide a data repository for the storage and correlation of information gathered from the individual kiosks 12 and mobile smart devices 16.

The game server 20 and kiosk 12 may include computing devices that access one or more computer-readable media that embody computer-readable instructions which, when executed by at least one computer, cause the computer(s) to implement one or more embodiments of the methods of the present subject matter.

Figure 2A:
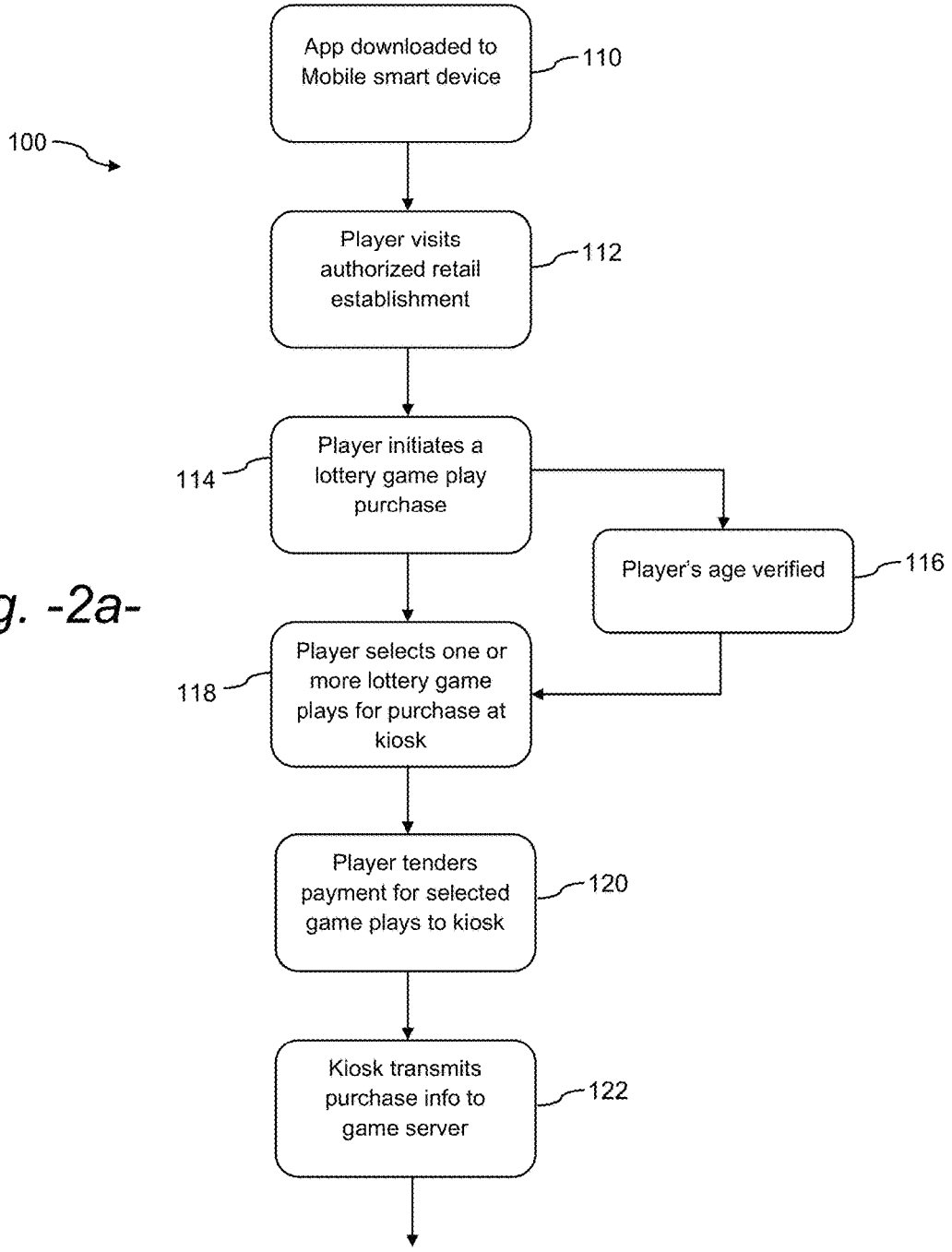
FIGS. 2*a* and 2*b* are flow diagrams of steps for a method embodiment in accordance with aspects of the present invention.
Figure 2B:
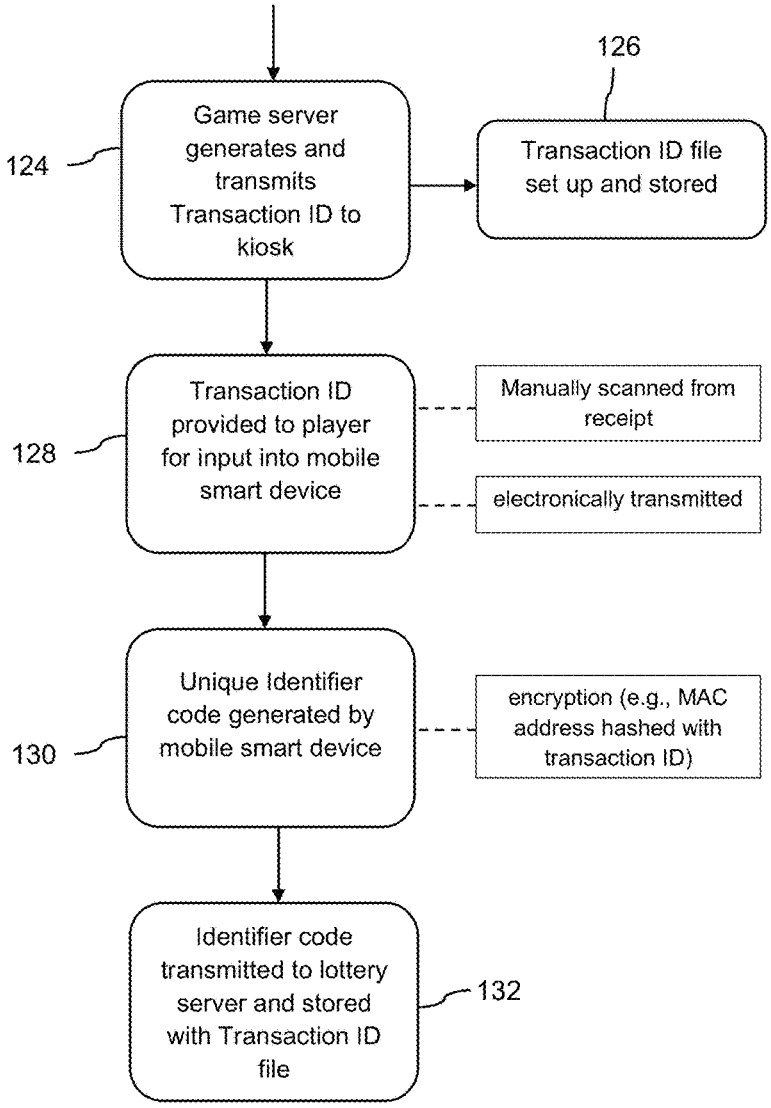
Figure 3:
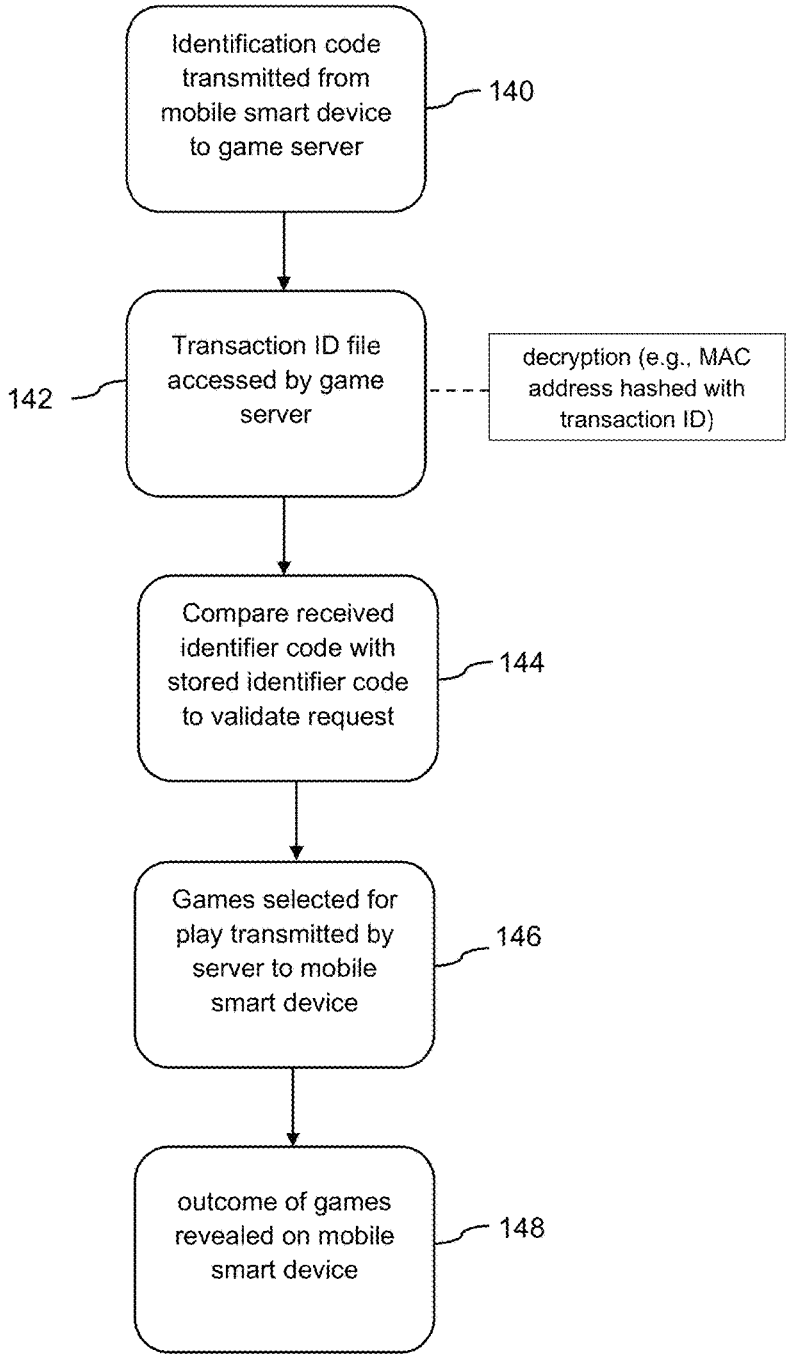
FIG. 3 is a flow diagram related to steps for play of lottery games obtained from the method steps of FIGS. 2*a* and 2*b*.

Referring now to FIGS. 2*a*, 2*b*, and 3 in addition to FIG. 1, certain aspects of the present method embodiments will be discussed in greater detail.

At step 110 in FIG. 2*a*, a player 14 downloads one or more applications to their mobile smart device 16 to enable the device 16 to function as described herein. One such application enables the mobile smart device 16 to communicate securely with the game server 20 via the secure network 30. As discussed above, another (or linked) application may be a low power background BTLE application that recognizes BTLE formatted signals from the kiosk 12.

At step 112, the player 14 visits an authorized retail establishment 10 that includes a kiosk 12. If the player so desires, at step 114, the player initiates a lottery game purchase transaction at the interactive kiosk 12. This step may include age verification of the player, as indicated at step 116.

At step 118, the player 14 interactively selects one or more game plays for purchase. For example, the player may select one of each of five different games, or multiple plays of the same game. The games may be predetermined and emulate conventional scratch-off lottery tickets that are virtually played on the player's mobile smart device 16 at the time of the player's choosing.

At step 120, the player 14 tenders cash or a credit/debit card 18 for purchase of the game plays. The kiosk 12 includes any manner of hardware and software configuration for completing the purchase transaction. For example, the kiosk may interface with a third party financial institution for a credit/debit card transaction.

At step 122, the kiosk 12 communicates the purchase transaction to the central lottery game server 20.

At step 124, upon receipt of the transaction information, the server 20 generates a transaction ID 22 associated with the transaction, and creates and stores an electronic file 26 associated with the transaction ID and the identity of the selected lottery game plays at step 126. The server 20 transmits the transaction ID 22 back to the kiosk 12.

At step 128, the transaction ID 122 is provided to the player by one of the means discussed above. For example, the ID may be printed on a receipt 36 by the kiosk 12 in the form a code that is scanned into the player's mobile smart device 16. Alternately, the transaction ID (code) 22 is transmitted wirelessly to the mobile smart device 16 by a suitable system 38, such as a BTLE system.

At step 130, upon receipt of the transaction ID, the unique identifier code 24 is generated by the mobile smart device 16. As discussed above, this identifier code 24 is unique to its respective mobile smart device, and can be generated in various ways. In a particular embodiment, the identifier code 24 is the MAC address of the mobile smart device 16 (which is meant to encompass a derivation or modification of the MAC address). However, MAC addresses are generally not secure, and step 130 may further include generating an encrypted hash of the MAC address, wherein the hash key is stored on the mobile smart device and also transmitted to the server 20. Alternatively, the hash key may be transmitted from the server 20 to the mobile smart device 16 with the transaction ID 22, and then used by the mobile smart device 16 to generate the encrypted unique identifier code 24.

The identifier code 24 desirably includes a component or link to the transaction ID 22 that enables the server 20 to retrieve the respective file 26 associated with the transaction ID 22. Thus, in certain embodiments, step 130 may include encrypting the transaction ID 22 with another component unique to the mobile smart device 16, such as the MAC address, to generate the identifier code 24. With this embodiment, the transaction ID 22 can be derived upon decryption of the identifier code 24 by the server 20 and subsequently used to identify the file 26 associated with the initial transaction. Instead of the transaction ID, the link to the file 26 may be any other flag or identifier transmitted by the server 20 to the mobile smart device 16 and embedded (e.g., hashed) with the subsequently generated unique identifier code 24.

The identifier code 24 is preferably not retrievable from the mobile smart device 16, and the downloaded application may limit transmission of the identifier code 24 only to the server 20, which prevents a player from transmitting the identifier code 24 to a third party.

Still referring to step 130, a respective identifier code 24 may be generated for each transaction ID 22 received by the mobile smart device 16. In an alternative embodiment, the identifier code 24 may be common to a plurality of transaction ID's such that the identifier code 24 essentially functions as a unique signature for the particular mobile smart device for multiple lottery game plays.

At step 132, the unique identifier code 24 is transmitted by the mobile smart device 16 to the server 20, where the code is accepted and stored with the transaction ID 22 and the identity of the selected lottery game play(s) in the respective file 26.

FIG. 3 depicts the process for subsequent play of the selected lottery game plays. At step 140, at a time of the player's choosing, the identifier code 24 is transmitted by the mobile smart phone 16 (via the downloaded application).

At step 142, the server 20 accepts the identifier code 24 and, if necessary, decrypts the code 24 to obtain the transaction ID 22 or other link to the file 26 associated with initial transaction.

At step 144, the server 20 compares the decrypted identifier code obtained in step 142 with the identifier code stored in the respective file 26 to validate the request.

If the received identifier code is valid, at step 146, the server retrieves the games selected for play and transmits the games to the player's mobile smart device. The games may be identified in the file, and retrieved and transmitted from a separate library of games. Alternatively, the complete games may be stored in the file, and transmitted from the file to the mobile smart device.

At step 148, outcome of the games is revealed to the player via a simulated game play on their mobile smart device. As mentioned above, the game plays may predetermined and revealed to the player by simulated play of the lottery game play on the mobile smart device. For example, the games may emulate conventional scratch-off lottery tickets that are scratched virtually on the mobile smart device to reveal the game results.

In other embodiments, the game play may be an entry in a future draw game.

The method may further include a redemption process wherein a winning lottery game play is credited to an account linked by the server to the unique identifier, with the account is accessible to the player upon subsequent transmission and receipt of the unique identifier by the server for prize redemption at an authorized redemption location or purchase of additional lottery game plays.

The material particularly shown and described above is not meant to be limiting, but instead serves to show and teach various exemplary implementations of the present subject matter. As set forth in the attached claims, the scope of the present invention includes both combinations and sub-combinations of various features discussed herein, along with such variations and modifications as would occur to a person of skill in the art.

What is claimed is:

1. A method for conducting a lottery game play purchase at a retail establishment wherein lottery game purchases are authorized by a lottery authority, the method comprising:

at an interactive kiosk located within the retail establishment and in communication with a central lottery server, accepting payment from a player via the kiosk for the purchase of a lottery game play selected by the player at the kiosk;

transmitting the purchase request from the kiosk to the server;

upon receipt of the purchase transaction request at the server, generating a transaction ID at the server associated with the lottery game play, and transmitting the transaction ID to the kiosk wherein, upon receipt of the transaction ID, the player is able to input the transaction ID to their mobile smart device via an application running on the mobile smart device, wherein upon receipt of the transaction ID, the mobile smart device generates a mobile smart device identifier code unique to and identifying the mobile smart device;

at the server, accepting the mobile smart device identifier code transmitted by the mobile smart device and storing the mobile smart device identifier code with the transaction ID and the selected lottery game play;

for subsequent play of the lottery game play, accepting at the server the mobile smart device identifier code transmitted by the mobile smart device, and retrieving and transmitting the selected lottery game play to the mobile smart device;

wherein the server does not require or store personal information related to the player with the mobile smart device identifier code and transaction ID for conducting the lottery game plays;

wherein the application running on the mobile smart device limits transmission of the mobile smart device identifier code to only the server such that the lottery game play is playable only on the mobile smart device that generated the mobile smart device identifier code; and wherein the mobile smart device identifier code is encrypted.

2. The method as in claim 1, wherein the lottery game play is predetermined and revealed to the player by simulated play of the lottery game play on the mobile smart device.

3. The method as in claim 1, wherein payment from the player at the kiosk is via a cash or credit card transaction, the kiosk transmitting to the server the payment amount, which is stored with the transaction ID.

4. The method as in claim 1, wherein the mobile smart device identifier code is generated by the mobile smart device and is unique for each transaction ID.

5. The method as in claim 1, wherein the mobile smart device identifier code is generated by the mobile smart device and is common to a plurality of transaction ID's.

6. The method as in claim 1, wherein the mobile smart device identifier code is derived from the media access control (MAC) address associated with the mobile smart device.

7. The method as in claim 6, wherein the mobile smart device identifier code is an encrypted hash of the MAC address generated by the mobile smart device.

8. The method as in claim 7, wherein a hash key for the encrypted hash is on the mobile smart device and present at the server.

9. The method as in claim 1, wherein the mobile smart device identifier code includes the transaction ID, which is used by the server to retrieve and transmit the selected lottery game play.

10. The method as in claim 9, wherein the mobile smart device identifier code is an encrypted hash of the transaction ID and a component unique to the mobile smart device.

11. The method as in claim 10, wherein the mobile smart device identifier code is an encrypted hash of the transaction ID and a media access control (MAC) address associated with the mobile smart device.

12. The method as in claim 1, wherein the transaction ID is provided to the player in the form of a code transmitted to the kiosk, the code scannable by the player with the mobile smart device.

13. The method as in claim 1, wherein the transaction ID is transmitted electronically to the player's mobile smart device from the kiosk.

14. The method as in claim 1, further comprising verifying the age of the player at the kiosk prior to accepting payment from the player.

15. The method as in claim 14, wherein the kiosk is in communication with a third party age verification service.

16. The method as in claim 1, wherein redemption of a winning lottery game play is credited to an account linked by the server to the unique mobile smart device identifier code, wherein the account is accessible to the player upon subsequent receipt of the unique mobile smart device identifier code for redemption or additional lottery game plays.

* * * * *